United States Patent [19]

King et al.

[11] Patent Number: 4,571,160

[45] Date of Patent: Feb. 18, 1986

[54] DIAPHRAGM PUMP HAVING A FLAT PLATE ACTUATING MEMBER SLIDABLE IN SLOTS

[75] Inventors: Robert D. King, Garland; James M. Henderson, Plano, both of Tex.

[73] Assignee: The Mead Corporation, Dayton, Ohio

[21] Appl. No.: 633,836

[22] Filed: Jul. 24, 1984

[51] Int. Cl.[4] ..... F04B 43/02; F01B 19/02

[52] U.S. Cl. ..... 417/437; 417/413; 417/571; 92/100; 74/49

[58] Field of Search ..... 417/413, 437, 564–566, 417/555 R, 571; 92/98 R, 100, 140; 74/47, 49, 55; 29/156.5 A

[56] References Cited

U.S. PATENT DOCUMENTS

| | | | |
|---|---|---|---|
| 375,199 | 12/1887 | Roe | 74/49 X |
| 1,595,064 | 8/1926 | Barrett | 74/49 X |
| 2,359,960 | 10/1944 | Anderson | 74/55 X |
| 2,463,766 | 3/1949 | Hadley | 417/413 X |
| 2,650,545 | 9/1953 | Cornelius | 92/100 X |
| 2,670,691 | 3/1954 | Guiot | 92/100 X |
| 2,748,606 | 6/1956 | Cornelius | 417/413 X |
| 2,981,197 | 4/1961 | Dolza | 417/571 X |
| 3,771,911 | 11/1973 | Turci | 417/413 |
| 3,776,666 | 12/1973 | Ludwig | 417/413 X |
| 3,831,548 | 8/1974 | Droege | 417/413 X |
| 4,086,036 | 4/1978 | Hagen et al. | 417/413 |
| 4,086,037 | 4/1978 | Stewart | 417/571 |
| 4,458,555 | 7/1984 | Holtzberg et al. | 29/156.5 A X |

FOREIGN PATENT DOCUMENTS

| | | | |
|---|---|---|---|
| 1005688 | 12/1951 | France | 92/100 |
| 268893 | 10/1929 | Italy | 417/555 R |
| 318501 | 6/1934 | Italy | 92/100 |

*Primary Examiner*—William L. Freeh
*Assistant Examiner*—Paul F. Neils
*Attorney, Agent, or Firm*—Biebel, French & Nauman

[57] ABSTRACT

A diaphragm pump of the type having a housing forming a pump chamber, a diaphragm attached to an outer periphery thereof to the housing within the chamber, inlet and outlet valves communicating with the chamber, and a motor having an eccentrically rotating driveshaft, in which a connecting rod is attached to the diaphragm and includes a substantially flat portion which extends through slots formed in the housing, and an aperture which receives the drive shaft of the motor and is sized to form a slip fit therewith. The slots are shaped to slidably receive the flat portion of the rod and constrain its motion, when displaced by rotation of the drive shaft, to a single plane which is perpendicular to a rotational axis of the drive shaft, thereby eliminating the transmission of thrust and torsional loads between the rod and drive shaft so that the motor bearing life is increased.

5 Claims, 3 Drawing Figures

DIAPHRAGM PUMP HAVING A FLAT PLATE ACTUATING MEMBER SLIDABLE IN SLOTS

BACKGROUND OF THE INVENTION

The present invention relates to pumps, and more particularly, to diaphragm pumps having a relatively small displacement.

Diaphragm pumps are commonly used to pump gases or liquids in fluid systems which do not require a high volume flow rate of fluid. A diaphragm pump typically includes a housing forming a pump chamber, a flexible diaphragm attached to the housing and located within the chamber, a motor having an eccentrically rotating drive shaft, a connecting rod attached at one end to the diaphragm and at an opposite end to the drive shaft, and inlet and outlet valves communicating with the pump chamber and having fittings for connecting the pump to the remainder of the fluid system. The rotational motion of the eccentric drive shaft of the motor is transmitted by the connecting rod to the diaphragm, and causes the diaphragm to be flexed within the chamber, thereby alternately increasing and decreasing the effective volume of the chamber. This change of volume alternately draws fluid into the chamber through the inlet valve and forces fluid from the chamber through the outlet valve.

A typical example of such a diaphragm pump is shown in Hagen et al. U.S. Pat. No. 4,086,036. In that pump, the eccentric drive shaft is press fitted within the inner race of a ball bearing bushing. The connecting rod is attached to a clamp which is fitted about the outer race of the ball bearing bushing. The connecting rod is supported within the pump by the diaphragm at an upper end and by the bearing races at a lower end, so that movement of the connecting rod and diaphragm is constrained by the engagement between the inner bearing race and the eccentric drive shaft of the motor.

Since the diaphragm is annular in shape, reactive forces are exerted against the connecting rod during operation in all directions, which are transmitted back to the eccentric drive shaft. Therefore, forces are exerted on the drive shaft and its mounting bearings within the motor which are parallel to the rotational axis, perpendicular to the rotational axis, and torsional loads. The transmission of these types of loads to the drive shaft of the motor causes excessive wear of the motor bearings which is likely to shorten the effective life of the motor.

Another type of diaphragm pump is disclosed in Pleuger U.S. Pat. No. 2,853,015. That patent discloses a diaphragm-type pump in which the connecting rod rides at a lower end thereof against an eccentric cam. A disadvantage with this type of pump is that the sliding friction of the cam against the lower end of the rod creates an area of high friction, which not only generates excessive heat during prolonged operation but requires hardened components which increase the overall cost of fabricating the pump.

Accordingly, there is a need for a diaphragm pump which substantially eliminates the transmission of thrust and torsional loads between the connecting rod and the eccentric drive shaft. In addition, such a diaphragm pump should be relatively inexpensive to manufacture and requires a minimum of parts made from hardened, metallic materials which increase the overall expense of the pump.

SUMMARY OF THE INVENTION

The present invention is a diaphragm pump in which the connecting rod includes a substantially flat, plate portion which is received in and slides relative to a pair of slots formed in the pump housing. The slots are shaped to constrain the movement of the connecting rod to a plane which is oriented substantially perpendicular to an axis of rotation of the drive shaft. In addition, the plate portion receives the drive shaft in an aperture which is shaped to provide a slip fit, so that the drive shaft and connecting rod may move relative to each other in a direction parallel to the drive shaft axis.

By constraining the movement of the connecting rod to a plane oriented perpendicularly to an axis of rotation of the drive shaft, the transmission to the drive shaft bearings of thrust loads—that is, loading applied in a direction parallel to the axis of rotation—is substantially eliminated. In addition, torsional loads which might be applied to the drive shaft by a twisting of the connecting rod about an axis perpendicular to the drive shaft axis are eliminated as well, since the connecting rod is prevented from pivoting about its longitudinal axis by its engagement with correspondingly shaped slots in the housing. The possibility of the transmission of thrust loads from the connecting rod to the drive shaft is further reduced by the slip fit engagement between the connecting rod and the drive shaft, which allows the two to move relative to each other in a direction parallel to the drive shaft axis.

In a preferred embodiment, the pump consists of a housing having upper and lower chamber walls attached to each other to form a pump chamber, the lower chamber wall having an upper slot therethrough, a rear bracket wall extending from the lower chamber wall, a front bracket wall spaced from the rear bracket wall to form a lower slot, and a pair of gussets for supporting the front bracket wall. A diaphragm is attached at its outer periphery to the housing within the chamber, and the upper chamber wall includes inlet and outlet valves which are adapted to be connected to a fluid system. A connecting rod is attached at one end to the diaphragm and includes a substantially flat, plate portion which extends through the upper and lower slots and includes an aperture which is shaped to receive the eccentric drive shaft of a motor in a slip fit. In the preferred embodiment, the aperture is defined by the inner race of a double-sealed ball bearing which is press fitted into the connecting rod.

The unique construction of the vacuum pump enables the pump to be manufactured from relatively inexpensive plastic materials. For example, in a preferred embodiment, the pump components exclusive of the diaphragm and connecting bolts are made of an acetal resin such as Delrin. ("Delrin" is a registered trademark of the E. I. Du Pont De Nemours & Co., Wilmington, Del.)

Accordingly, it is an object of the present invention to provide a vacuum pump in which the transmission of thrust and torsional loads to the eccentric drive shaft of the driving motor from the connecting rod is reduced substantially; and a vacuum pump which can be made of relatively inexpensive materials and yet have a relatively long operating life.

Other objects and advantages of the invention will become apparent from the following description, the accompanying drawings and the appended claims.

DESCRIPTION OF THE PREFERRED EMBODIMENT

Figure 1:
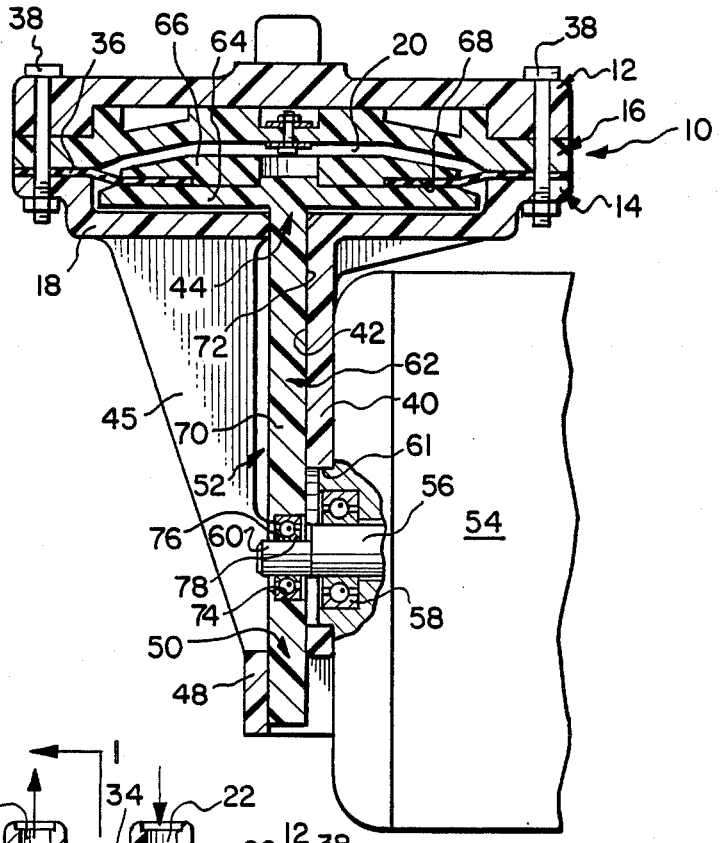
FIG. 1 is a side elevation in section of a preferred embodiment of the vacuum pump of the present invention, taken at line 1—1 of FIG. 2, and showing a fragment of a driving motor which is partially broken away to reveal the drive shaft bearings.

As shown in the figures, the diaphragm pump of the present invention comprises a housing, generally designated 10, having an upper chamber wall 12, a lower chamber wall 14, and a valve plate 16. The upper chamber wall 12 and valve plate 16 are substantially disk-shaped, and the lower chamber wall 14 includes a disk-shaped portion 18. The upper chamber wall 12, lower chamber wall 14 and valve plate 16 form a pump chamber 20.

The upper chamber wall 12 includes an inlet orifice 22 and an outlet orifice 24 (FIG. 2) which are adapted to be connected to a fluid system (not shown). The inlet orifice 22 communicates with an aperture 26 formed in the valve plate 16, and the outlet orifice 24 communicates with an aperture 28 formed in the valve plate. Apertures 26, 28 connect the inlet and outlet orifices, respectively, with the pump chamber 20.

The inlet aperture 26 is sealed by a stainless steel leaf 30 at a lower end thereof, and the outlet aperture 28 is sealed by a second stainless steel leaf 32 at an upper end thereof. The leaves 30, 32 are attached to the valve plate 16 by a nut and bolt combination 34.

An annular diaphragm 36, preferably made of rubber, is attached at its outer periphery to the housing 10 and forms a lower boundary of the pump chamber 20. As best shown in FIG. 1, the diaphragm 36 is clamped between the outer peripheries of the disk-shaped portion 18 and valve plate 16. The upper chamber wall 12, valve plate 16, diaphragm 36 and disk-shaped portion 18 are held together by cap screw and nut combinations 38, which are spaced about the periphery of the housing.

The lower chamber wall includes a plate-shaped bracket 40, extending perpendicularly from the disk-shaped portion 18 and includes a substantially flat surface 42. A transverse slot 44 is formed in the disk-shaped portion 18 and is oriented immediately adjacent to an upper end of the flat surface 42. A pair of gussets 45, 46 extend downwardly from the disk-shaped portion 18 and are attached to the bracket 40 at lower ends thereof. A front bracket wall 48 extends between the gussets 45, 46 and is spaced outwardly from the flat surface 42 of bracket 40 to form a lower transverse slot 50 which is aligned with upper transverse slot 44. Each of the gussets 45, 46 forms a clearance slot 52 with the bracket 40.

The bracket 40 is attached to an electric motor 54 of conventional design by screws 55. Motor 54 includes and eccentric drive shaft 56 which is supported by bearings 58. An offset pin 60, which is displaced from a central axis of rotation of the shaft 56, provides the eccentric movement of the shaft when the shaft is rotated. The shaft 56 and pin 60 extend through a hole 61 in the bracket 40.

The annular diaphragm 36 is attached to a connecting rod, generally designated 62. The connecting rod 62 includes a plate-shaped head 64 and an annular piece 66, the latter of which receives the annular diaphragm in an annular recess 68 which extends about its periphery. The annular piece 66 is clamped to the head 64 by screws (not shown), so that the diaphragm 36 is held against the head 64 and forms a seal therewith. The diaphragm 36 and annular piece 66 forms a lower boundary of the pump chamber 20.

Figure 2:
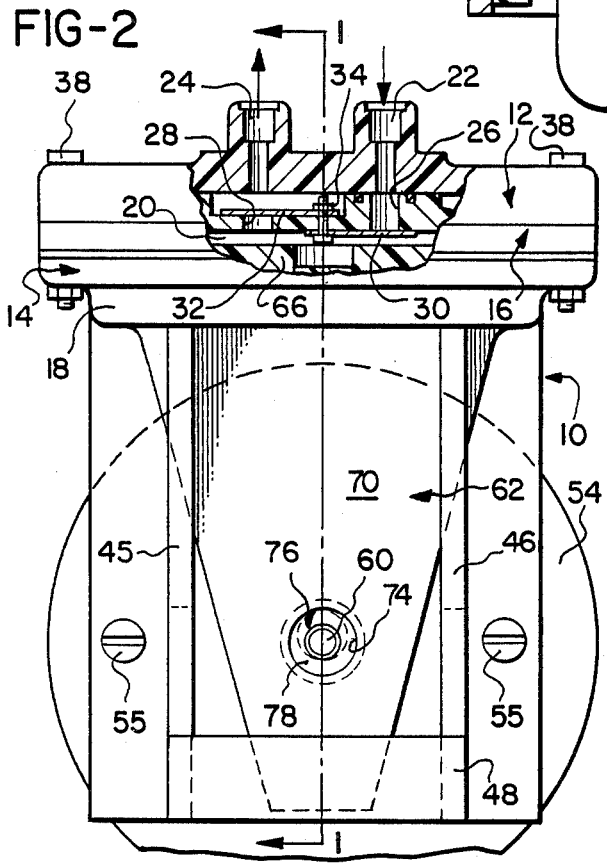
FIG. 2 is a front elevation of the vacuum pump of FIG. 1 in which the driving motor is partially broken away and the pump chamber is partially in section to reveal its interior.
Figure 3:
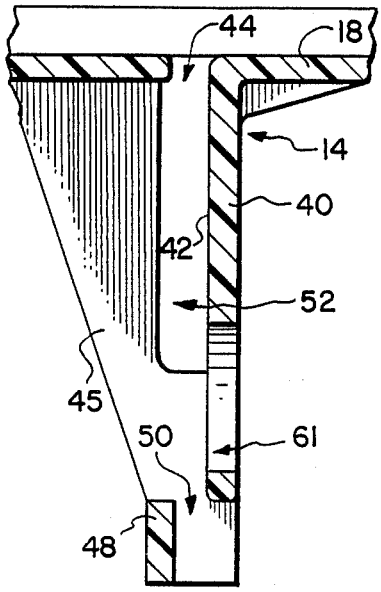
FIG. 3 is a detail of a side elevation in section of the lower chamber wall of the pump of FIG. 1.

The connecting rod 62 includes a substantially flat, plate portion 70 which preferably is formed integrally with the head 64 and extends downwardly through the slots 44 and 50. As best shown in FIG. 2, the plate portion 70 is somewhat triangular in shape, and its upper portion extends within the clearance slots 52 of the gussets 45, 46. The plate portion 70 includes a flat rear wall 72 which abuts and slides against the flat surface 42 of bracket 40. A lower part of the plate portion 70 includes an aperture 74 which receives double-sealed ball bearings 76 in a press fit. The inner race 78 of the bearings 76 is shaped and positioned to receive the offset pin 60 of the drive shaft 56 in a slip fit. This slip fit is sufficiently loosely toleranced to allow relative movement between the connecting rod 62 and the drive shaft 56 in a direction parallel to a rotational axis of the drive shaft.

During operation of the pump, the eccentric drive shaft 56 rotates, causing the offset pin 60 to move in a circular path which is concentric with the central axis of rotation of the drive shaft. This orbital motion is transferred to the connecting rod 62 which effects a rocking motion of the head 64, causing the diaphragm 36 to reciprocate toward and away from the valve plate 16. This reciprocal motion causes the volume of the pump chamber 20 to expand and contract, thereby alternately opening and closing the leaves 30, 32 of the inlet and outlet apertures 26, 28 as fluid is drawn into the pump chamber and pumped out of it. The transverse slots 44, 50 are shaped to allow sliding motion of the plate portion 70, but are sufficiently closely toleranced to the profile of the plate portion at these points of contact that the plate is constrained to move in a plane which is perpendicular to the axis of rotation of the drive shaft 56.

This constrained movement substantially eliminates the possibility of the connecting rod 62 twisting about an axis perpendicular to the drive axis, thereby imparting a torsional load on the drive shaft 56. Furthermore, since the connecting rod is constrained to move in this perpendicular plane, it cannot move relative to the drive shaft 56 in a direction parallel to the rotational axis, and thereby generate trust loads on the bearings 58. The chance that these thrust loads could be transmitted from the connecting rod 62 is even further reduced by the relatively loosely toleranced slip fit between the inner race 78 and the offset pin 60, which allows relative movement between the connecting rod 62 and drive shaft 56 along the rotational axis.

While the form of apparatus herein described constitutes a preferred embodiment of this invention, it is to be understood that the invention is not limited to this precise form of apparatus and that changes may be made therein without departing from the scope of the invention.

What is claimed is:

1. For use with a motor having an eccentrically rotating drive shaft, a diaphragm pump comprising:

a housing forming a pump chamber;

inlet and outlet valve means communicating with said chamber for connecting said chamber to a fluid system;

diaphragm means positioned within said chamber and attached to said housing;

rod means having a head attached to said diaphragm and including a substantially flat plate portion extending from said head through said housing, said plate portion having an aperture shaped to matingly receive an eccentrically rotating drive shaft pin in a slip fit such that orbital motion of an engaged pin imparts a corresponding orbital motion to said plate portion, and said plate portion may be displaced in a direction parallel to a rotational axis of an associated eccentric drive shaft and not transmit a thrust load thereto; and said housing including slot means having upper and lower slots slidably receiving said plate portion therethrough at upper and lower ends thereof and shaped to constrain displacement of said plate portion in said orbital motion to a single plane substantially perpendicular to a rotational axis of an associated eccentric drive shaft, whereby said head imparts a rocking motion to said diaphragm and the transmission of thrust and torque loads from said rod means to an engaged drive shaft is substantially eliminated.

2. The pump of claim 1 wherein said housing includes an upper chamber wall; a lower chamber wall forming said upper slot means; a rear bracket wall extending from said lower chamber wall and including a substantially flat surface slidably engaging said plate portion and oriented parallel to said plane; and a front bracket wall spaced from said rear bracket wall and forming said lower slot therewith.

3. The pump of claim 2 wherein said housing includes gusset means extending from said lower chamber wall and attached to said front and rear bracket walls.

4. For use with a motor having an eccentrically rotating drive shaft, a diaphragm pump comprising:

a housing forming a pump chamber and including an upper chamber wall, a lower chamber wall forming upper slot means, a rear bracket wall extending from said lower chamber wall and including a substantially flat surface, and a front bracket wall spaced from said rear bracket wall and forming lower slot means therewith;

inlet and outlet valve means communicating with said chamber for connecting said chamber to a fluid system;

diaphragm means positioned within said chamber and attached to said housing;

rod means attached to said diaphragm and including a substantially flat plate portion extending from said chamber through said housing, said plate portion having means for receiving a rotating drive shaft therein;

said upper and lower slot means being positioned to slidably receive said plate portion and constrain displacement thereof to a single plane substantially perpendicular to a rotational axis of an associated drive shaft, thereby substantially eliminating transmission of thrust and torque loads from said rod means thereto; and said flat surface being positioned to slidably engage said plate portion and being oriented parallel to said plane.

5. A diaphragm pump comprising:

motive means having an eccentrically rotating drive shaft;

a housing having an upper chamber wall, a lower chamber wall attached to said upper chamber wall to form a pump chamber therewith, said lower chamber wall having an upper slot therethrough, a rear bracket wall extending from said lower chamber wall and attached to said motive means, said rear bracket wall including a substantially flat surface, a front bracket wall spaced from said rear bracket wall and forming a lower slot therewith, and gusset means for supporting said front bracket wall;

inlet and outlet valve means attached to said upper chamber wall for connecting said chamber with a fluid system;

a diaphragm attached at an outer periphery thereof to said housing within said chamber such that said valve means is separated from said upper slot;

rod means attached to said diaphragm and including a substantially flat plate portion extending through said upper and lower slots and slidably engaging said flat surface; said plate portion having an aperture sized to receive said drive shaft in a slip fit, whereby said rod means may move relative to said drive shaft in a direction parallel to a rotational axis thereof; and said slots shaped to slidably engage said plate portion whereby movement of said rod means in response to rotation of said drive shaft is constrained to a single plane perpendicular to said rotational axis, said slots and said aperture cooperating to substantially eliminate the transmission of thrust and torsional loads between said rod means and said drive shaft.

* * * * *